United States Patent [19]

Baumann

[11] 4,260,073

[45] Apr. 7, 1981

[54] VIRGIN TONER AND USED TONER SUPPLY APPARATUS AND METHOD

[75] Inventor: Gerald W. Baumann, Boulder, Colo.

[73] Assignee: International Business Machines Corporation, Armonk, N.Y.

[21] Appl. No.: 936,286

[22] Filed: Aug. 23, 1978

[51] Int. Cl.[3] ..... G03G 15/00

[52] U.S. Cl. ..... 222/1; 118/652; 118/691; 222/148; 222/318; 222/DIG. 1; 355/3 DD

[58] Field of Search ..... 222/1, 148, 318, DIG. 1, 222/136, 135; 118/646, 652; 355/3 DD, 14, 15; 15/256.52

[56] References Cited

U.S. PATENT DOCUMENTS

| | | | |
|---|---|---|---|
| Re. 28,589 | 10/1975 | Knight et al. | 222/148 |
| 3,641,979 | 2/1972 | Gerbasi et al. | 118/646 |
| 3,659,556 | 5/1972 | Mutschler | 118/646 |
| 3,700,328 | 10/1972 | Davidge | 355/15 |
| 3,752,576 | 8/1973 | Gerbasi | 118/646 X |
| 3,793,986 | 2/1974 | Latone | 355/15 X |
| 3,918,808 | 11/1975 | Narita | 355/15 |
| 3,957,509 | 5/1976 | McMullen | 15/256.52 X |
| 3,982,043 | 9/1976 | Simpson | 355/15 X |
| 3,989,372 | 11/1976 | Davidge et al. | 355/15 |
| 4,032,227 | 6/1977 | Hubbard et al. | 355/14 |

OTHER PUBLICATIONS

"Toner Holder for Xerographic Machine", vol. 3, No. 1, *Xerox Disclosure Journal*, 1/78, 63, Spencer.

*Primary Examiner*—Stanley H. Tollberg
*Assistant Examiner*—Fred A. Silverberg
*Attorney, Agent, or Firm*—Francis A. Sirr

[57] ABSTRACT

An electrophotographic apparatus of the two-component, dry developer and reusable photoconductor type, having a developer unit, and replenisher for supplying toner to the developer unit. The replenisher includes a first supply of virgin toner, and a second supply of used toner. A toner feed device operates to simultaneously feed toner to the developer unit from the first and second replenisher supplies. The proportion of toner fed from the first and second supplies is variable; however, such proportion requires that virgin toner must always be fed. Used toner is provided by collecting toner at the apparatus' cleaning station. Toner-low indication is provided for only the first supply, so as to prevent the feeding of only used toner. A toner concentration sensor signals the need to feed the combination of virgin-/used toner to the developer unit.

13 Claims, 7 Drawing Figures

VIRGIN TONER AND USED TONER SUPPLY APPARATUS AND METHOD

DESCRIPTION

1. Technical Field

This invention concerns an electrophotographic apparatus, for example a copier, wherein virgin and used toner are simultaneously supplied, in controlled proportion, to the apparatus' developer unit.

2. Background Art

The economic advantage of reusing toner, which is recovered from the reusable photoconductor of an electrophotographic apparatus during cleaning thereof, is well known in the art. In transfer electrophotography, the photoconductor's latent image first passes through a developer station, such as a magnetic brush developer, whereat this image is toned and becomes visible. This toned image is then mated with plain paper at a transfer station whereat about 50% of the photoconductor's toner image is transferred to the paper. Subsequently, the remaining 50% of the photoconductor's toner is removed from the photoconductor, as the photoconductor moves through a cleaning station. As is evident, toner cost can be reduced if this used toner is returned to the developer unit for reuse.

Prior attempts to economize on toner usage have included automatic transport means, such as mechanical or airflow transport, of the used toner back to either the developer unit, or to the developer's replenisher. In the former arrangement, the used toner directly combines with the developer's toner/carrier mix, and is reused. In the latter arrangement, the used toner generally piles on top of the virgin toner then in the replenisher, and returns to the developer mix at a later time. In neither arrangement is the proportion of virgin toner to used toner, in the developer unit itself, controlled to any extent; and in the latter case, it is possible at one time to dispense only virgin toner to the developer unit, while at another time dispensing only used toner thereto.

Other prior art has avoided toner transport problems associated with automatic toner transport means by collecting used toner in bottles or cartridges, at the aforementioned cleaning station. Periodically, these bottles are emptied into the developer's replenisher, where the used toner then resides as a homogeneous volume, usually on top of a homogenous volume of virgin toner. Here again, it is most likely that either all virgin toner or all used toner is supplied to the developer unit at any given time, and in any event the proportion of virgin toner to used toner is not known or controlled.

As stated above, toner reuse has been achieved both automatically and manually.

An example of automatic toner reuse is shown, for example, in U.S. Pat. No. 3,700,328, incorporated herein by reference, wherein, in one embodiment, an auger transports residual toner from a magnetic brush cleaner to a magnetic brush developer. Another such means, embodying a bead-chain means to transport the toner, is shown in U.S. Pat. No. 3,957,509, incorporated herein by reference.

A manual toner reuse arrangement is exemplified by collecting toner in a bottle at the cleaning station, and subsequently reusing this residual toner by removing this bottle and coupling it to the developer, as exemplified by U.S. Pat. No. 3,793,986, for example, incorporated herein by reference. That patent describes a xerographic copier wherein a vacuum-type cleaner, including a cyclone particle separator, cooperates to clean the copier's photoconductor. The residual used toner, separated from the airstream by the above-mentioned separator, is collected in bottles. Both the above-mentioned separator, and the copier's developer toner dispenser have couplings allowing an empty bottle to be coupled to the separator, for filling, and a full bottle to be coupled to the toner dispenser, for reuse of the toner.

The Invention

The general object of this invention is to reduce toner consumption in a xerographic device.

A further object is to reuse toner by virtue of a toner dispenser which jointly meters or dispenses virgin toner and used toner to a xerographic device's developer unit.

A further object is to provide such an arrangement which prevents the dispensing of only used toner, by providing a means responsive to the absence of virgin toner to indicate the need to add such toner, as by the replacement of an empty cartridge with a cartridge full of virgin toner.

Yet a further object is to provide such an arrangement where automatic toner transport is eliminated, and used toner is collected at a photoconductor cleaning station in a container, such container subsequently being coupled to the xerographic device's toner dispenser, and an empty such container then being coupled to the cleaning station.

The invention specifically achieves these and other objects by the use of a toner dispenser capable of receiving a first container of virgin toner and a second container of used toner. A similar second container is also located at a photoconductor cleaning station, and operates to collect used toner. Subsequently, this container is removed from the cleaning station and is placed on the toner dispenser, as it replaces an empty such second container. The feeding of only virgin toner is acceptable, i.e. acceptable copies are provided. However, the feeding of only used toner is not acceptable, since the copy quality can be adversely affected. A toner-low sensor indicates and/or inhibits further copier operation when the first container empties, whereupon it is replaced with a similar such container full of virgin toner.

The foregoing and other features of this invention, as well as its advantages and applications, will be apparent from the following detailed description, and the description of the preferred embodiments which are illustrated in the accompanying drawing.

DESCRIPTION OF THE PREFERRED EMBODIMENT

In machines of the electrophotographic type, charged, latent electrostatic images are produced on photoreceptive material, and then developed through the application of developer mix. In transfer electrophotography, the photoreceptive material is separate from the copy paper, and transfer of the developed image to the copy paper takes place, with subsequent fusing of the developed image to the paper. A common type of two-component developer mix currently in use in such machines is comprised of a carrier material, such as a charged magnetic bead, coated with an oppositely charged, colored substance called toner. The toner is attracted to the charged, latent image to develop that image. The toner is then transferred from the latent image to the copy paper. The copy paper is then separated from the photoreceptive material. Finally, the toner is fused to the copy paper to produce the finished copy.

It is apparent from the procedure outlined above that toner is a supply item which must be periodically replenished, to the developer mix, since toner is carried out of the machine on the copy paper as a reproduced image. The concentration of toner particles in the developer mix is significant to quality development of the latent image, since too low a toner concentration will result in too light a developed image, and too high a toner concentration will result in too dark a developed image.

Figure 1:
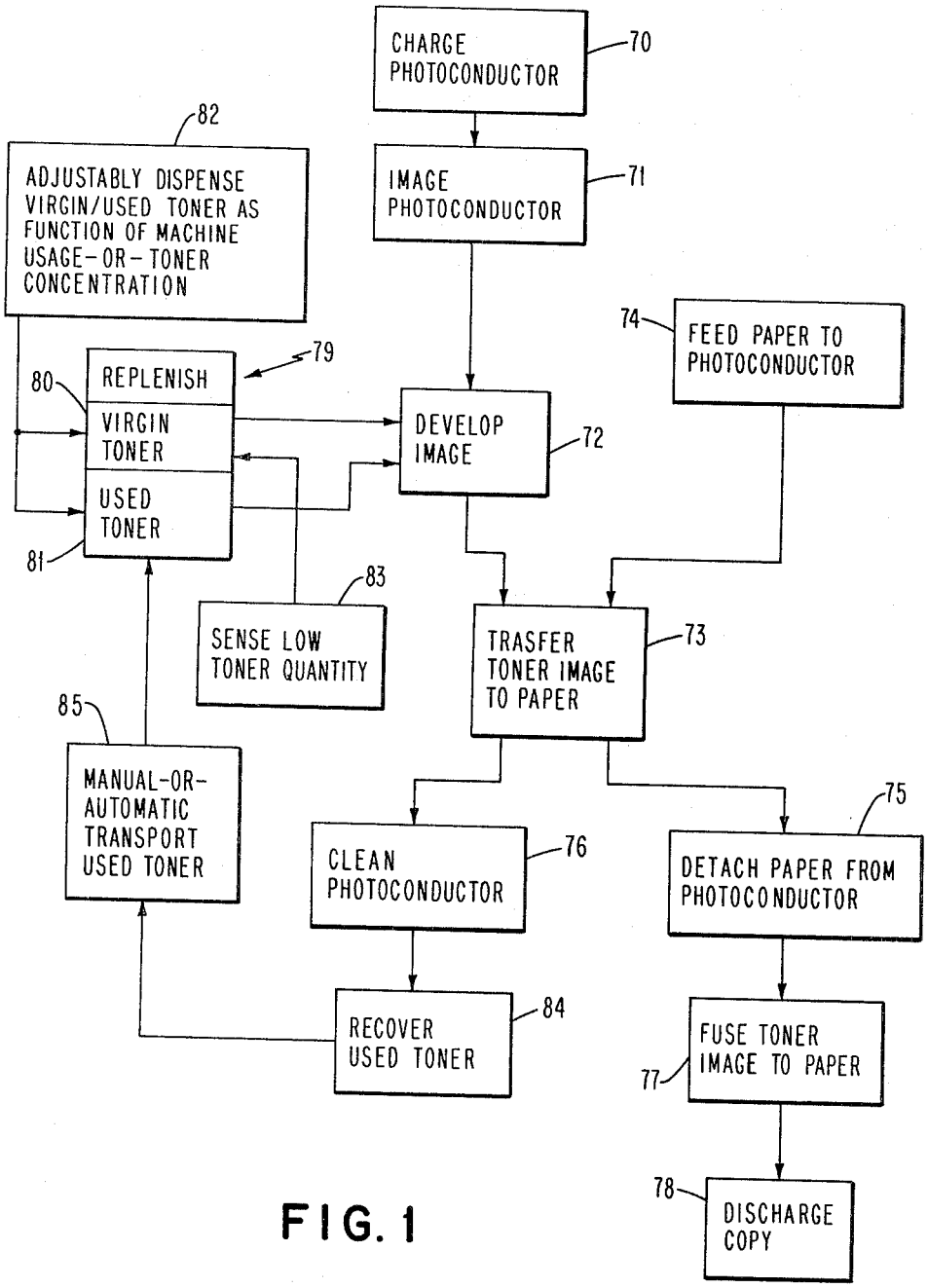
FIG. 1 is a schematic representation of a generic transfer electrophotographic apparatus embodying the present invention.

Referring now to the drawing, and initially to FIG. 1, there is shown a generic representation of a transfer electrophotographic apparatus embodying the present invention.

Charging of the photoconductor is represented by block 70. As represented by this block, a photoconductor surface is given a high, uniform electrostatic charge, for example, by being passed, in the absence of light, beneath a charge corona.

The next step in the process is represented by block 71, namely that of forming a copy image on the photoconductor. More specifically, the charged photoconductor may be exposed to bright light reflected from an original document to be copied. The light reflected from the white parts of the document discharge corresponding areas of the photoconductor. The minimal light reflected from the original document's dark or printed areas fails to materially discharge the photoconductor. Consequently, an electrostatic latent image remains on those photoconductor areas which correspond to the dark or printed areas on original document.

This latent image is now passed through a developer, as represented by block 72. As a result of development, a reverse-reading visual toner image of the original document now resides on the photoconductor. During development block 72, the electrostatic latent image of the original document is coated with a pigmented powder or toner. This toner has an electrostatic charge of the opposite polarity to that of the photoconductor's charged areas. As a result, the toner particles adhere electrostatically to these charged areas, but do not adhere to the discharged or substantially uncharged areas.

The next step in the process is transfer block 73 whereat the photoconductor's toner image is transferred to the sheet of paper which was fed at block 74.

During the transfer step, a portion of the photoconductor's developed image is transferred to the sheet by bringing the sheet substantially into contact with the photoconductor, and by causing the toner to be transferred electrostatically from the photoconductor to the sheet.

After transfer is completed, the sheet is stripped from the photoconductor, as represented by block 75.

Since the photoconductor retains a residual toner image after transfer, the photoconductor must be cleaned, as at block 76. During this cleaning step, residual toner is removed from the photoconductor, thereby preventing this residual toner from interferring with reuse of the same photoconductor area for copying of the same or a different original document.

In order to complete the copy process, the toner, now carried by the paper sheet, is fused to the paper, as at block 77. Thereafter the finished copy is discharged from the copier, as at block 78.

As toner is used, during repeated operation of blocks 70–78, it is replenished by block 79. This replenishment is accomplished by jointly feeding virgin toner from replenisher 80 and used toner from replenisher 81. Such replenishment can be accomplished open-loop, as a function of the number cycles of blocks 70–78, i.e. machine usage, or can be accomplished closed-loop, as a function of toner concentration measurement, block 82. Whatever the replenishment means selected, this means is controllable to feed virgin/used toner in a selected proportion.

Since it is undesirable to feed only used toner, block 83 senses a low quantity of virgin toner and provides an appropriate alarm indication, and perhaps inhibits further operation of blocks 70–78.

Used toner is recovered as a function of cleaning residual toner from the photoconductor, by block 84, and is automatically or manually transported back to replenisher 79 by block 85.

The FIG. 1 generic disclosure of the present invention will enable those skilled in the art to apply the present invention to a wide variety of specific electrophotographic architectures.

Figure 2:
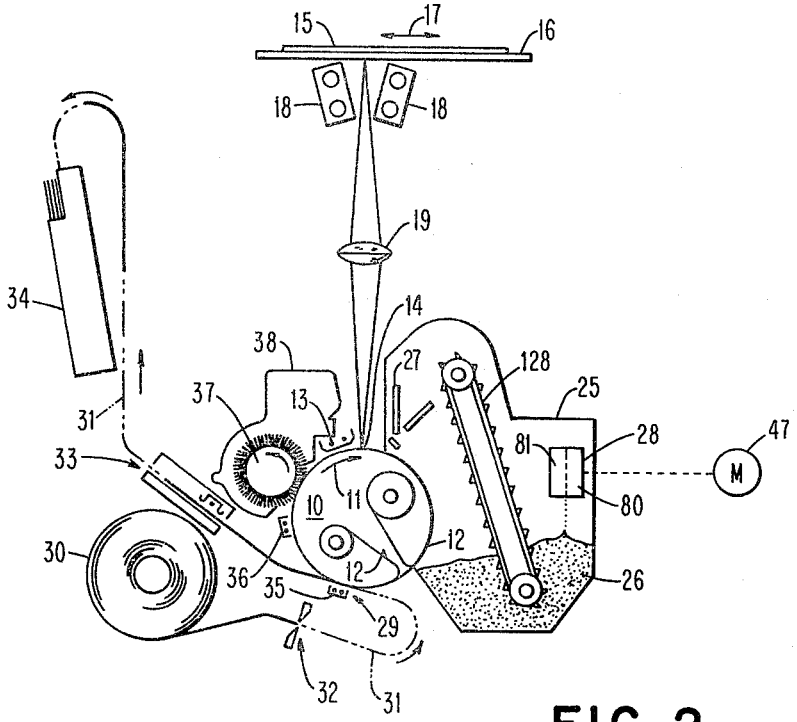
FIG. 2 is one xerographic apparatus architecture embodying the present invention.

Referring now to FIG. 2, there is shown a xerographic-copying machine architecture embodying the present invention. The electrophotographic member of the copying machine comprises a drum 10 which is mounted for rotation in the direction indicated by arrow 11. Disposed on the outer periphery of the drum is a thin layer of photosensitive material 12 which is supported on a conductive substrate. The photoconductor is coated on a flexible conductive backing material and stored on reels within the interior of the drum to permit replacement or changing of the operative photoconductor surface without removing the drum from the machine.

Disposed about the periphery of the drum 10 are a number of processing stations which carry out the conventional steps of the xerographic-copying process. An initial charging station is provided by corona unit 13 which deposits a uniform charge on the surface of the photosensitive material while the same is maintained in the dark. The next station is exposure station 14 where a line image of the original document is projected onto the uniformly charged surface of photosensitive material 12 as the drum rotates. A document 15 to be copied is supported face down on a movable and transparent copy bed 16 which moves back and forth past a scanning slit as indicated by the arrow 17. The document 15 passing the scanning slit is illuminated by lights 18 and a line image of light and shadow is projected by stationary lens 19 onto photosensitive material 12 carried by the drum.

The next station in the direction of rotation of the drum 10 is cascade developer unit 25 where a two component toner/carrier developer mix is caused to move across the surface of the drum. The developer mix comprises relatively large carrier particles and much smaller heat fixable marking particles of toner. The developer composition is transported from sump portion 26 of the developer unit to the chute structure 27 by bucket conveyor 128. The developer mix falls or cascades across the surface of the drum and the toner particles are attracted to and deposited on the surface of the photosensitive member in accordance with the latent electrostatic image corresponding to the original. As the toner is used or depleted from the developer mix, it is necessary to replenish the toner. This is accomplished by two-part toner dispenser means 28 which is the subject of this invention and will be hereinafter more fully described. The result of the cascade development operation is the formation of a toner image on the surface of the drum. It is now necessary to transfer the toner image to a copy sheet. This is accomplished at the toner transfer station 29.

Plain copy paper is stored within the copying machine in roll form as indicated by roll 30, and is fed along a path of travel 31 in the direction indicated by the arrows leading past knives 32, toner image transfer station 29, fusing apparatus generally indicated by reference numeral 33 and then to output copy hopper 34. The copy paper is cut to the length selected by the operator, and the cut copy sheet moves into contact with the drum. A transfer corona unit 35 assists in the transfer of the toner image to the copy sheet. The copy sheet is then separated from the drum, the toner image fused by heat and the final copy transported to the output hopper 34.

Not all of the toner image is transferred to the copy sheet and it is necessary to remove the residual toner from the surface of the drum. This is accomplished by employing a preclean corona unit 36 whose corona discharge tends to loosen the remaining toner particles, and a cleaning station 38 whereat cleaning brush 37 is rotated at high-speed in the direction indicated by the arrow.

The above description of a representative xerographic-copying machine is not intended to limit in any manner the teachings or claims of this invention. The toner reuse apparatus and method disclosed in this specification can be employed with any of a wide variety of xerographic machines or systems.

If magnetic brush development is desired, arrangements such as shown, for example, in U.S. Pat. No. 3,754,526, or the IBM TECHNICAL DISCLOSURE BULLETINS of September 1972, at pages 1251 and 1252, and December 1975, at pages 2048 and 2049, incorporated herein by reference, may be used.

Whatever type of developer is used, it may be desirable to provide a means to mix the dispensed virgin/-residual toner with the depleted toner/carrier mix returning to the developer's sump from the developing mix. Such a means is described, for example, in U.S. Pat. No. 3,947,107, incorporated herein by reference.

Figure 3:
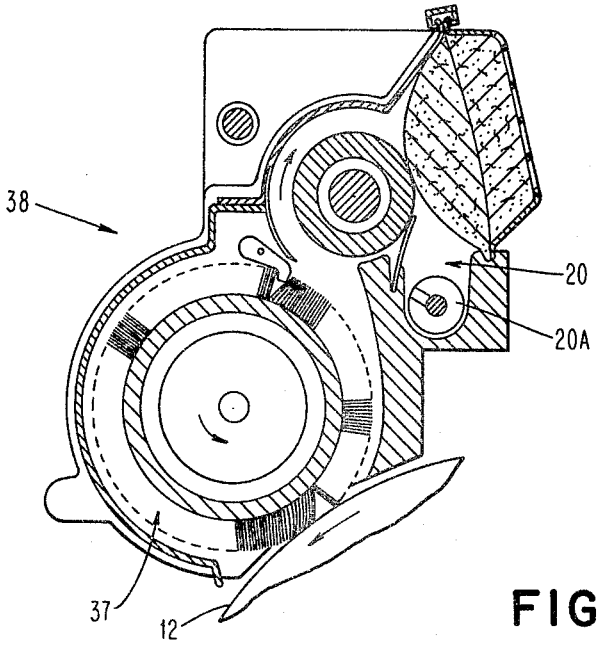
FIG. 3 is a showing of a preferred cleaning station for the device of FIG. 2.

A preferred cleaning station 38, to be used in an enabling construction of the present invention, is that described in U.S. Pat. Nos. 3,989,372 and/or 3,955,235, incorporated herein by reference. FIG. 3 shows a cross-sectional view of this cleaning station. As described in U.S. Pat. No. 3,989,372, residual toner recovery area 20, and its auger 20A, enable residual toner to be collected for reuse.

Figure 4:
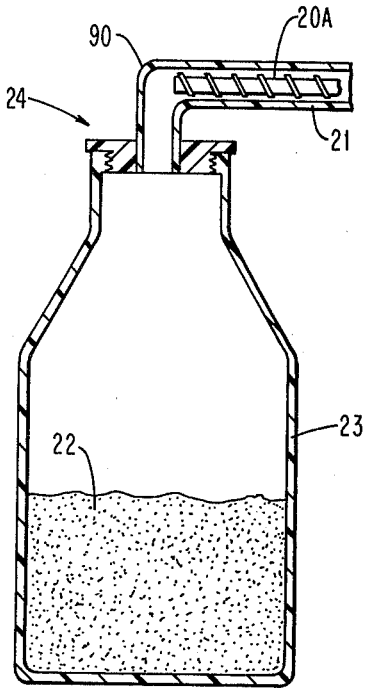
FIG. 4 is a showing of the means whereby the auger of FIG. 3's cleaning station operates to enable collection of residual toner in a bottle or cartridge for later reuse.

As shown in FIG. 4, auger 20A extends horizontally, preferably toward the back of the copier, through a tube 21 which is rigidly mounted to the copier's frame, not shown. Tube 21 includes a 90°-turn portion 90 whereat the delivery end of auger 20A terminates. At this point transported residual toner 22 gravity-drops into bottle or cartridge 23.

In any given copier system, a desired coupling scheme may be provided to couple a bottle or cartridge of toner to the developer's dispenser. Whatever this scheme, a similar coupling is provided at 24 to couple bottle 23 to the lower end of tube portion 90.

U.S. Pat. No. 4,060,105, incorporated herein by reference, shows an exemplary coupling scheme for eliminating or minimizing the danger of toner spillage as a toner bottle is dumped into the developer's dispenser unit.

Figure 5:
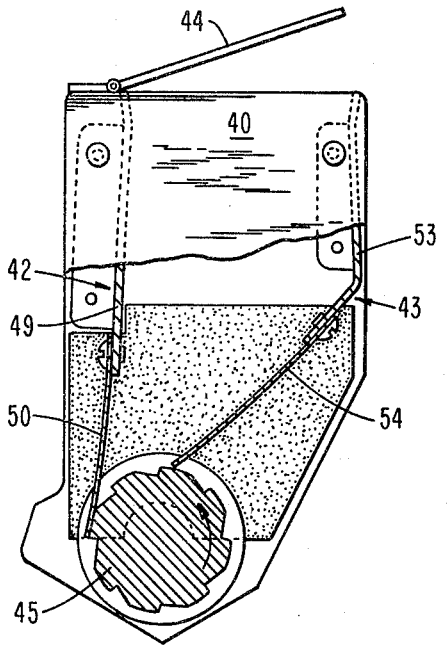
FIG. 5 PRIOR ART
FIG. 5 is a showing of one of the two dispensers making up the dispenser means of FIG. 2, one of these dispensers housing virgin toner, and the other housing residual toner recovered from FIG. 2's cleaning station, as by the use of FIG. 4's collecting scheme.

The toner dispenser means 28 of FIG. 2 comprises two individual dispensers 80 and 81, one of which is shown in FIG. 5. One of these two dispensers (80) houses virgin toner, whereas the other (81) houses residual toner cleaned from photosensitive material 12 by FIG. 2 and 3's cleaning station 38.

More specifically, each dispenser comprises an elongated hopper 40. For example, the individual hoppers 40 of each dispenser may be aligned such that their individual rotatable fluted-dispensing shafts 45 lie on a common axis. Each of the dispensing shafts 45 forms the bottom wall of hopper 40, at the apex of front and back walls 42 and 43. Front wall 42 includes a rigid portion 49 and a resilient member 50.

Back wall 43 is generally similar and comprises a rigid portion 53 and a resilient portion 54.

A cover 44 is provided to enable hopper 40 to be resupplied with toner, as by manually dumping a bottle or cartridge of toner therein. As stated, one of the two dispensers is dedicated to virgin toner and the other to used, residual toner recovered at cleaning station 38.

The dispenser of FIG. 5 is more completely described in U.S. Pat. No. Re. 28,589, incorporated herein by reference.

In operation, dispensing shaft 45 may be open-loop rotated at a relatively slow speed by drive motor means 47 (FIG. 2), so long as copies are being produced. This drive motor means may comprise a single drive motor, and two adjustable gear couplings to selectively enable different metering of virgin and used toner, or may comprise two drive motors whose speed of rotation is individually adjustable to enable such selective metering. An exemplary adjustable coupling is shown in U.S. Pat. No. 3,946,910, incorporated herein by reference.

Other dispensing arrangements will of course be apparent to those of skill in the art.

As a further feature of the present invention, the use of a closed-loop metering scheme, rather than the above-mentioned open-loop scheme, may be provided. Such a closed-loop scheme is exemplified by the use of well known toner concentration measuring, sensing and control apparatus which operate to sense the proportion of toner to carrier, and to control motor means 47 so as to maintain a desired toner concentration.

Figure 6:
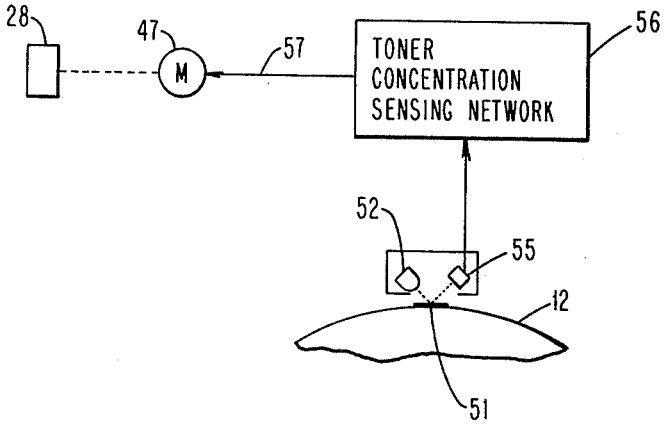
FIG. 6 shows a reflectance toner concentration sensing scheme for use with the apparatus of FIG. 2.

While toner concentration sensing, measuring and control means are well known to those of skill in the art, an improved toner concentration measuring/sensing means of the type which may be used as an element of the present invention is that shown in FIG. 6 and described in copending and commonly assigned U.S. patent application Ser. No. 894,955, filed Apr. 10, 1978, in the names of L. M. Ernst et al, incorporated herein by reference. Another exemplary such means is shown in U.S. Pat. No. 3,756,192, incorporated herein by reference.

Whatever toner concentration control means is selected by one skilled in the art, the result of all such means is that a need to add toner causes a signal to be sent to toner replenisher means 28, which holds a supply of virgin and used toner, and this replenisher means is then operated or energized to dump a measured amount of these two type toners into the electrophotographic machine's developer unit 25.

As described in the above-mentioned copending application, reflectance measurements are first made on a toned test area 51 of photosensitive material 12, by means of LED 52 and photosensor 55, and then on a cleaned portion of material 12. Toner concentration sensing network 56 of that application then developes an output signal 57 indicating a need, or no-need, to energize motor means 47, so as to enable or not-enable dispensing of virgin/used toner from dispenser means 28 to the sump of developer unit 25.

As a further feature of the present invention, a toner-low sensing means is associated with only that one of the two individual FIG. 5 toner dispensers which is dedicated to virgin toner. It has been found that the dispensing of only used toner to developer unit 25 may produce copies of less than desirable quality. While the exact phenomenon which causes this quality degradation is not known, it has been found desirable to operator-indicate, and perhaps inhibit further copying, when a low supply of virgin toner exists.

An exemplary proportion of virgin/used toner to be added, upon each occasion of such a need to add, is the ratio 1 to 1.

Figure 7:
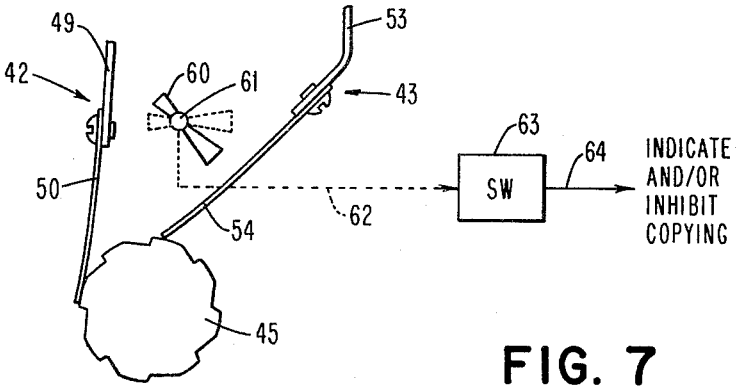
FIG. 7 shows a means of detecting a low supply of virgin toner in the dispenser which is dedicated thereto.

While many such means are known to those of skill in the art, of which the means of Reissue U.S. Pat. No. Re. 28,589 is one example, on such means, shown in FIG. 7, is described in U.S. Pat. No. 3,896,279, incorporated herein by reference. With reference to FIG. 7, the dispenser dedicated to virgin toner includes a paddle 60, rotatable about axis 61, and having diametrically opposed blades of significantly different surface areas. Paddle 60 is biased, by means not shown, so that the blades tend to assume a generally horizontal orientation, shown in broken lines. Because of these surface area differences, the blades assure the full-line, tilted attitude when the dispenser has adequate virgin toner therein. As the virgin toner is depleted, paddle 60 rotates to the dotted-line position, under the influence of its bias.

Paddle 60 is connected, as by means 62, to a switch 63. When the paddle is in its dotted line position, switch 63 enables its output 64 so as to provide a signal which indicates to the operator the need to resupply virgin toner to the virgin toner dispenser, and/or to inhibit further copying.

While the invention has been particularly shown and described with reference to preferred embodiments thereof, it will be understood by those skilled in the art that various changes in form and details may be made therein without departing from the spirit and scope of the invention; for example, automatic transport can be provided to return used toner from cleaning station 38, rather than manual transport, as described relative the FIG. 4 dispensers.

What is claimed is:

1. A method of supplying toner to the developer unit of an electrophotographic device having a reusable photoconductor, comprising the steps of:

providing a first toner supply having toner of a first characteristic and first metering means;

providing a second toner supply having toner of a second characteristic and second metering means; and providing motor means and adjustable coupling means coupling said motor means to said first and second metering means, said coupling means being adjustable to facilitate control of the proportion of toner of said first and second characteristic which is supplied to said developer unit upon operation of said motor means.

2. The method of claim 1 including the steps of cleaning residual toner from said photoconductor, and providing said residual toner as said toner of said second characteristic.

3. The method of claim 2 wherein toner of said first characteristic is virgin toner.

4. A method of supplying toner to the developer station of an electrophotographic process means, such means having a reusable photoconductor and a cleaning station, comprising the steps of:

providing a first toner container having toner of a first characteristic therein and having first dispensing means;

providing a second toner container having toner of a second characteristic therein and having second dispensing means; and providing motor means and adjustable coupling means connecting said motor means to said first and second dispensing means, said motor means when operative, comprising the sole means by which both toners are simultaneously supplied to said developer station from both of said containers, so long as toner is contained in both of said containers, and said coupling means facilitating adjustment of the proportions of the toners which are simultaneously supplied.

5. The method of claim 4 wherein said first toner container supplies virgin toner, and said second toner container supplies used toner, and including the step of collecting used toner cleaned from said photoconductor by said cleaning station.

6. The method of claim 5 including the step of replenishing said second toner container with said used toner.

7. The method of claim 6 including the steps of indicating a minimal quantity of toner within said first toner container, and indicating the need to add first toner.

8. The method of claim 7 including the steps of measuring toner concentration, and controlling said motor means to so supply toner of said first and second characteristic upon the measurement of a given low concentration.

9. The method of claim 8 wherein the toner concentration of a mix of toner of said first and second characteristic is measured.

10. In an electrophotographic device of the dry developer unit type, having a developer unit, the improvement comprising:

a two-chamber toner dispenser for dispensing toner to said developer unit, one chamber of said toner dispenser being dedicated for use with virgin toner, and the other being dedicated for use with used toner, a metering means for each of said two-chambers, motor means and adjustable coupling means coupling said motor means to said metering means, said motor means being operable upon actuation thereof to jointly and simultaneously supply virgin and used toner to said developer unit and said coupling means enabling adjustment of the proportion of virgin and used toner so supplied.

11. The device of claim 10 including means operable to sense the quantity of virgin tone in said one chamber of said toner dispenser, and to provide an output as a result of the sensing of a minimum quantity.

12. The device of claim 11 including toner concentration sensing means operable to provide an output as a result of the sensing of a need to dispense virgin and used toner to said developer unit.

13. The device of claim 12 including a reusable photoconductor, and a photoconductor cleaning station operable to supply the used toner.

* * * * *